US012228122B2

(12) United States Patent
Vieille et al.

(10) Patent No.: US 12,228,122 B2
(45) Date of Patent: Feb. 18, 2025

(54) PUMPING SYSTEM IN THE LAB-ON-A-CHIP FIELD

(71) Applicants: Institut Polytechnique de Grenoble, Grenoble (FR); Centre National de la Recherche Scientifique, Paris (FR); Université Grenoble Alpes, Saint-Martin-d'Hères (FR)

(72) Inventors: Victor Vieille, Vimines (FR); Thibaut Devillers, Fontaine (FR)

(73) Assignees: Institut Polytechnique de Grenoble, Grenoble (FR); Centre National de la Recherche Scientifique, Paris (FR); Université Grenoble Alpes, Saint-Martin-d'Hères (FR)

( * ) Notice: Subject to any disclaimer, the term of this patent is extended or adjusted under 35 U.S.C. 154(b) by 0 days.

(21) Appl. No.: 17/761,591

(22) PCT Filed: Sep. 10, 2020

(86) PCT No.: PCT/EP2020/075379
§ 371 (c)(1),
(2) Date: Mar. 17, 2022

(87) PCT Pub. No.: WO2021/052865
PCT Pub. Date: Mar. 25, 2021

(65) Prior Publication Data

US 2024/0044322 A1 Feb. 8, 2024

(30) Foreign Application Priority Data

Sep. 17, 2019 (FR) ..... 1910252

(51) Int. Cl.
*F04B 43/04* (2006.01)
*F04B 43/00* (2006.01)

(52) U.S. Cl.
CPC ..... *F04B 43/04* (2013.01); *F04B 43/0027* (2013.01)

(58) Field of Classification Search
CPC ... F04B 43/04; F04B 43/0027; F04B 43/0018
(Continued)

(56) References Cited

U.S. PATENT DOCUMENTS 3,743,446 A 7/1973 Mandroian
4,697,989 A * 10/1987 Perlov ..... A61M 60/462 417/474

(Continued)

FOREIGN PATENT DOCUMENTS

DE 102015218468 A1 3/2017
FR 1545918 A 11/1968

(Continued)

OTHER PUBLICATIONS

F. Amirouche, Y. Zhou, and T. Johnson, "Current micropump technologies and their biomedical applications," Microsyst. Technol., vol. 15, No. 5, pp. 647-666, May 2009.

(Continued)

*Primary Examiner* — Charles G Freay
*Assistant Examiner* — Benjamin Doyle
(74) *Attorney, Agent, or Firm* — Conley Rose, P.C.

(57) ABSTRACT

The invention relates to a system and an implementation method for pumping a fluid, the system comprising:

a pump comprising a flexible membrane which has two opposing surfaces, the membrane comprising a spatially rotating permanent magnetization structure, a rigid support means to which at least a portion of the lower surface of the membrane is attached, (Continued)

a source of a magnetic field which is capable of generating a magnetic drive field at the location of the membrane, the magnetic drive field having a substantially homogeneous orientation.

17 Claims, 5 Drawing Sheets

(58) Field of Classification Search
USPC ..... 417/413.1
See application file for complete search history.

(56) References Cited

U.S. PATENT DOCUMENTS

| | | | | |
|---|---|---|---|---|
| 5,096,388 | A * | 3/1992 | Weinberg | F04B 43/043 417/474 |
| 5,192,197 | A * | 3/1993 | Culp | F04B 35/04 417/322 |
| 5,705,018 | A * | 1/1998 | Hartley | F04B 43/14 216/2 |
| 5,961,298 | A * | 10/1999 | Bar-Cohen | F04B 17/003 417/322 |
| 6,007,309 | A | 12/1999 | Hartley | |
| 6,074,179 | A | 6/2000 | Jokela et al. | |
| 6,247,905 | B1 * | 6/2001 | Dohner | F04B 43/043 417/322 |
| 9,091,251 | B1 * | 7/2015 | Ullakko | F03G 6/121 |
| 2002/0081218 | A1 * | 6/2002 | Sharma | F04B 43/14 417/322 |
| 2008/0193307 | A1 | 8/2008 | Elata et al. | |
| 2012/0275929 | A1 * | 11/2012 | Salsman | F04B 43/04 417/322 |
| 2014/0017097 | A1 | 1/2014 | Conrad | |
| 2016/0211065 | A1 * | 7/2016 | Mullner | H10N 30/802 |
| 2018/0021775 | A1 | 1/2018 | Lindquist | |

FOREIGN PATENT DOCUMENTS

| | | | |
|---|---|---|---|
| JP | S6013994 | A | 1/1985 |
| JP | H0381585 | A | 4/1991 |
| WO | 2016058620 | A1 | 4/2016 |
| WO | 2021052865 | A1 | 3/2021 |

OTHER PUBLICATIONS

N.-T. Nguyen, X. Huang, and T. K. Chuan, "MEMS-Micropumps: A Review," J. Fluids Eng., vol. 124, No. 2, p. 384, 2002.
P. Woias, "Micropumps—past, progress and future prospects," Sens. Actuators B Chem., vol. 105, No. 1, pp. 28-38, Feb. 2005.
B. D. Iverson and S. V. Garimella, "Recent advances in microscale pumping technologies: a review and evaluation," Microfluid. Nanofluidics, vol. 5, No. 2, pp. 145-174, Aug. 2008.
C. D. Chin, V. Linder, and S. K. Sia, "Commercialization of microfluidic point-of-care diagnostic devices," Lab. Chip, vol. 12, No. 12, p. 2118, 2012.
T. Satoh et al., "A multi-throughput multi-organ-on-a-chip system on a plate formatted pneumatic pressure-driven medium circulation platform," Lab. Chip, vol. 18, No. 1, pp. 115-125, 2018.
"Links—Shaw Mountain Technology." [Online]. Available: http://shawmountaintechnology.com/links/. [Accessed: Apr. 12, 2018].
A. Saren, A. R. Smith, and K. Ullakko, "Integratable magnetic shape memory micropump for high-pressure, precision microbicidal applications," Microfluid. Nanofluidics, vol. 22, No. 4, Apr. 2018.
A. R. Smith, A. Saren, J. Järvinen, and K. Ullakko, "Characterization of a high-resolution solid-state micropump that can be integrated into microfluidic systems," Microfluid. Nanofluidics, vol. 18, No. 5-6, pp. 1255-1263, May 2015.
K. Ullakko, L. Wendell, A. Smith, P. Müllner, and G. Hampikian, "A magnetic shape memory micropump: contact-free, and compatible with PCR and human DNA profiling," Smart Mater. Struct.
A. Armstrong, K. Finn, A. Hobza, P. Lindquist, N. Rafla, and P. Müllner, "A motionless actuation system for magnetic shape memory devices," Smart Mater. Struct., vol. 26, No. 10, p. 105013, Oct. 2017.
S. Barker, E. Rhoads, p. Lindquist, M. Vreugdenhil, and P. Müllner, "Magnetic shape memory micropump for submicroliter intracranial drug delivery in rats," J. Med. Devices, vol. 10, No. 4, p. 041009, 2016.
W. Hu, G. Z. Lum, M. Mastrangeli, and M. Sitti, "Small-scale soft-bodied robot with multimodal locomotion," Nature, vol. 554, No. 7690, pp. 81-85, Jan. 2018.
Foreign Communication from a Related Counterpart Application, International Search Report dated Oct. 2, 2020, International Application No. PCT/EP2020/075379 filed on Sep. 10, 2020.
Foreign Communication from a Related Counterpart Application, Written Opinion dated Oct. 2, 2020, International Application No. PCT/EP2020/075379 filed on Sep. 10, 2020.

* cited by examiner

[Fig. 1]
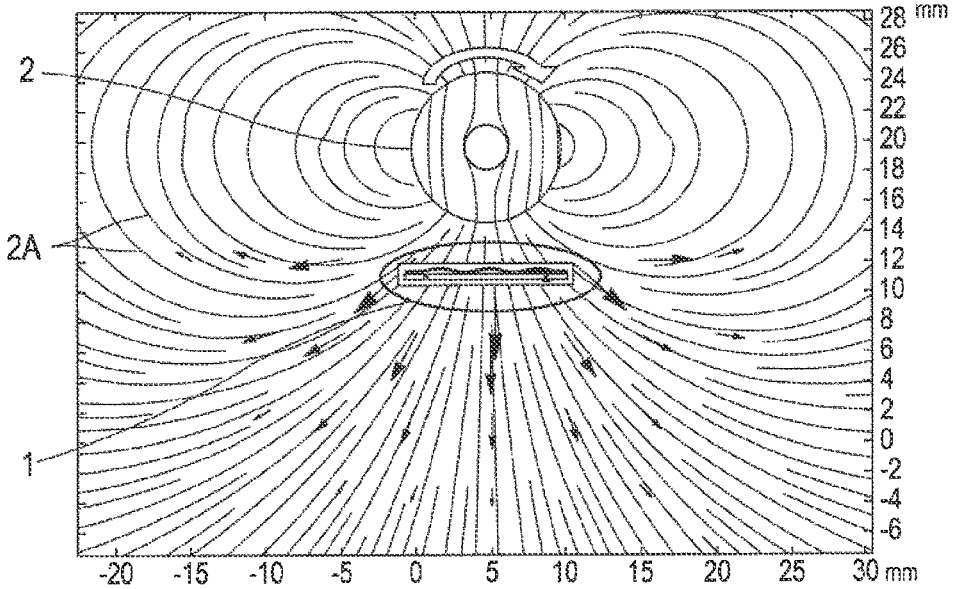
[Fig. 2A]
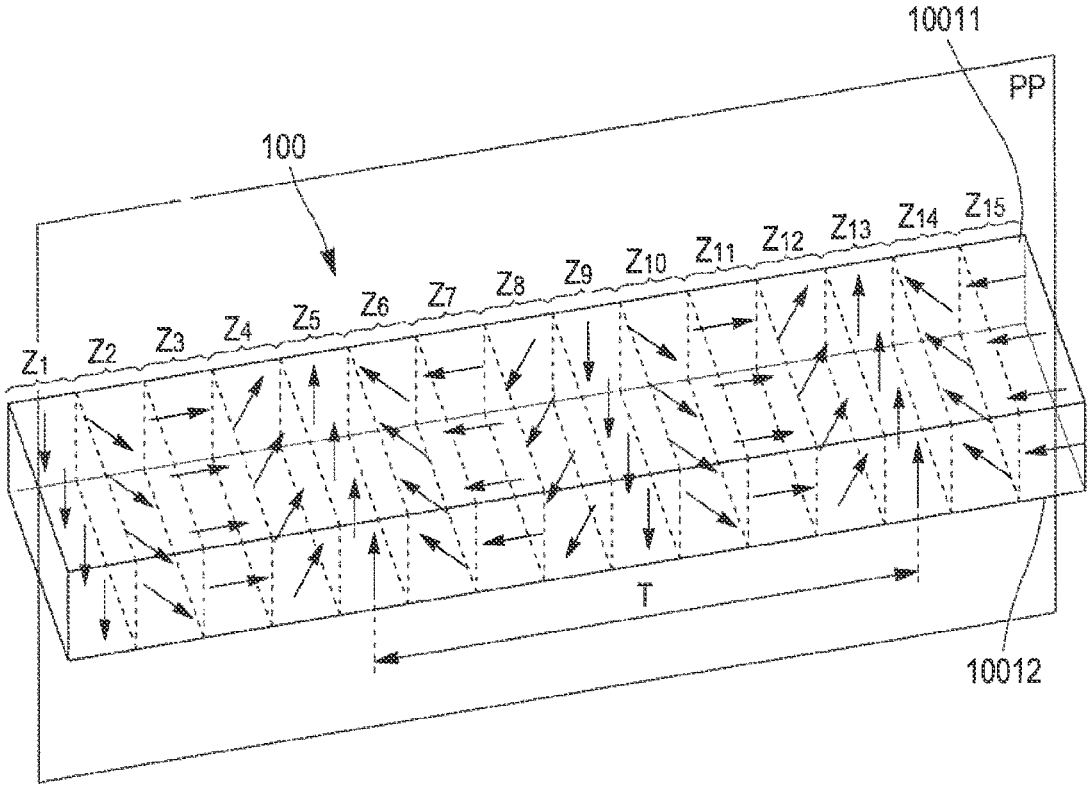

[Fig. 2B]
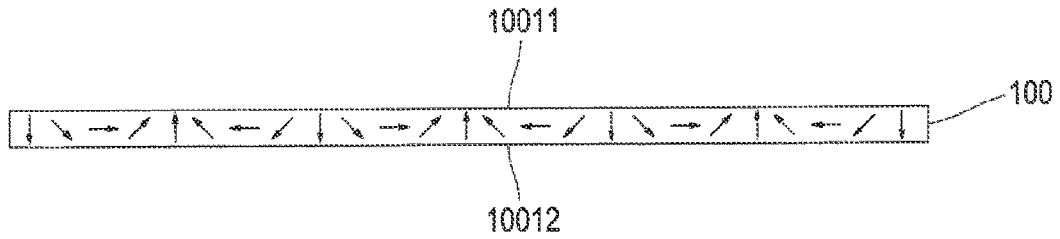
[Fig. 3A]
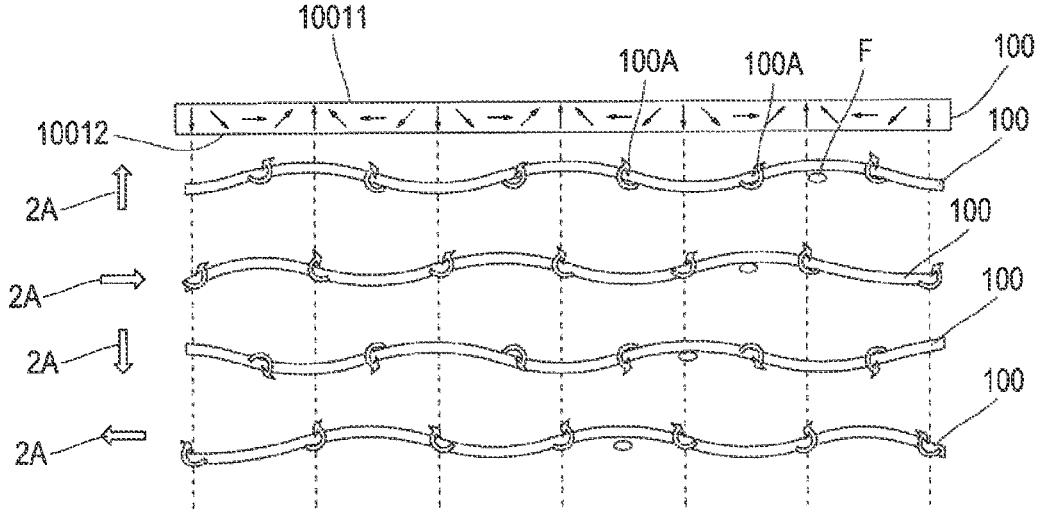
[Fig. 3B]
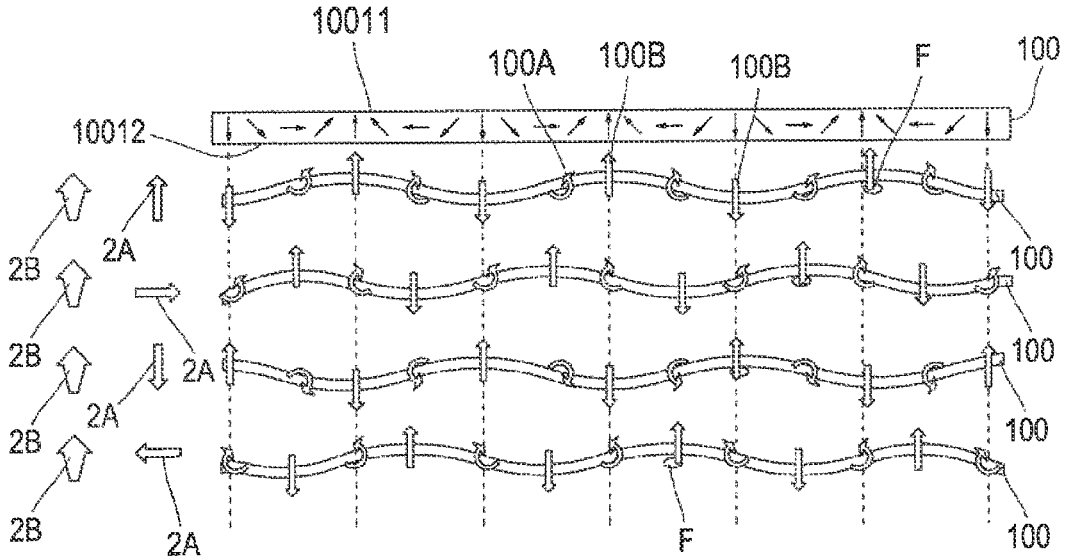

[Fig. 3C]
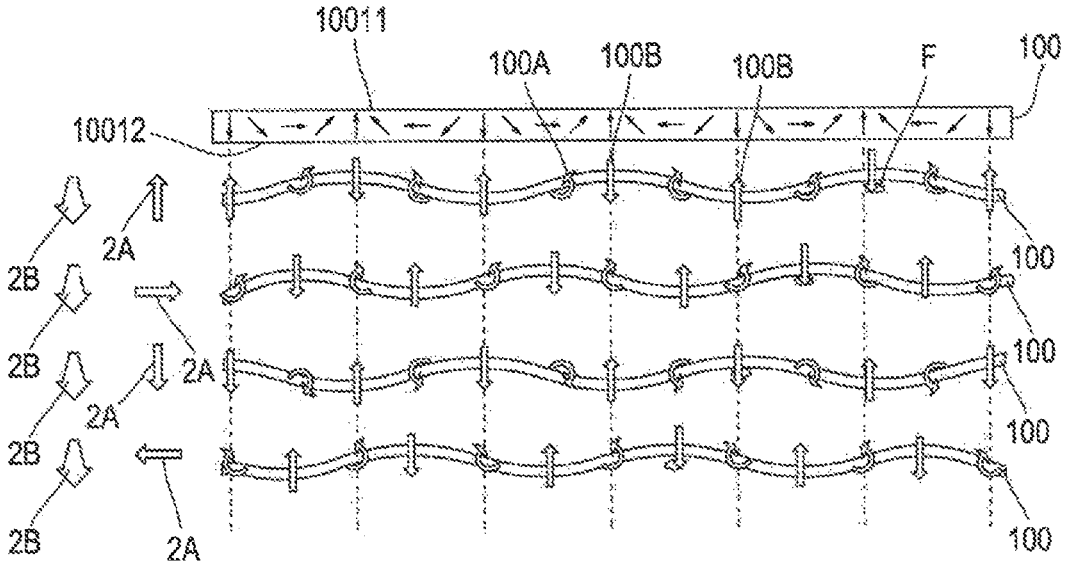
[Fig. 4A]
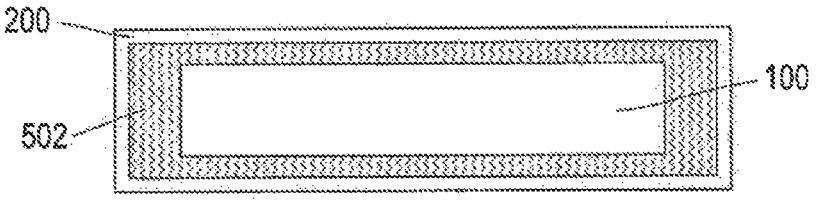
[Fig. 4B]
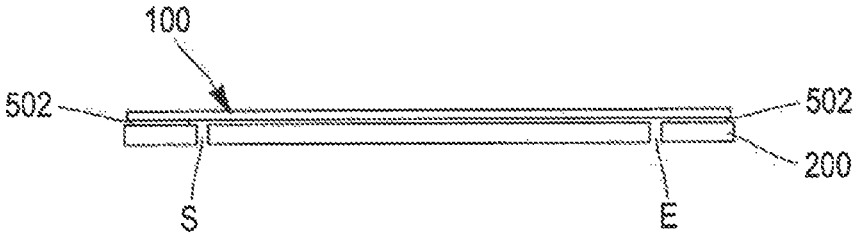
[Fig. 4C]
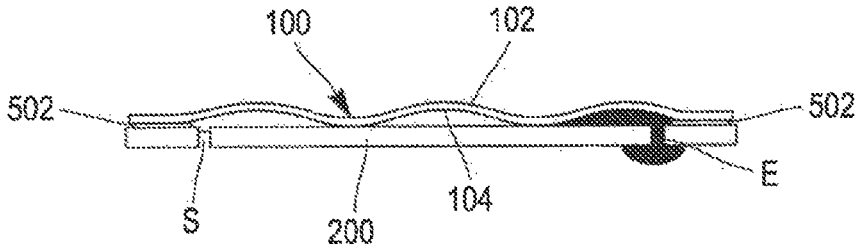

[Fig. 4D]
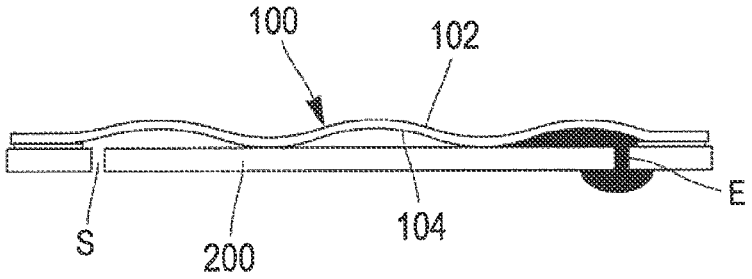
[Fig. 4E]
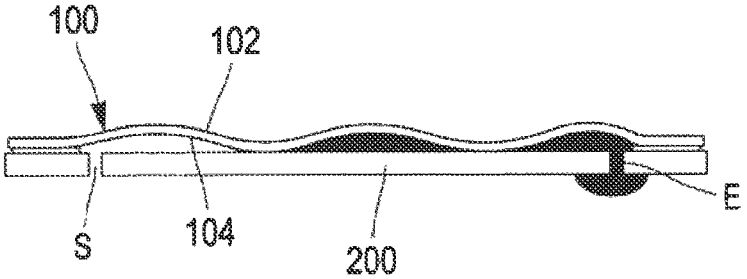
[Fig. 5]
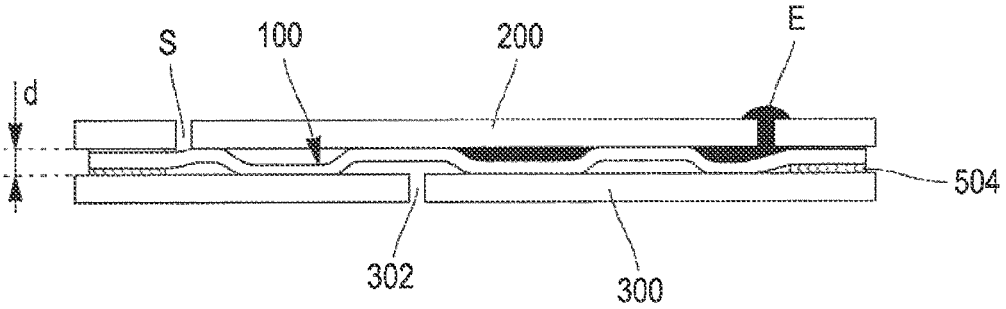
[Fig. 6]
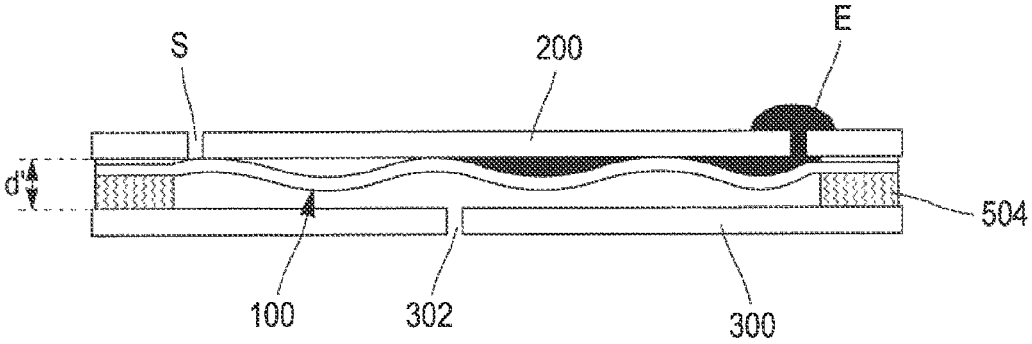

[Fig. 7]
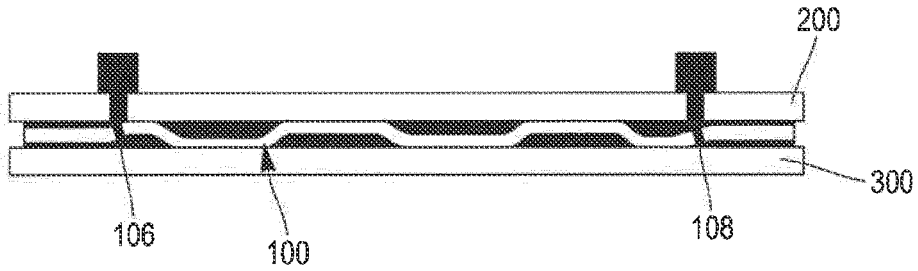
[Fig. 8]
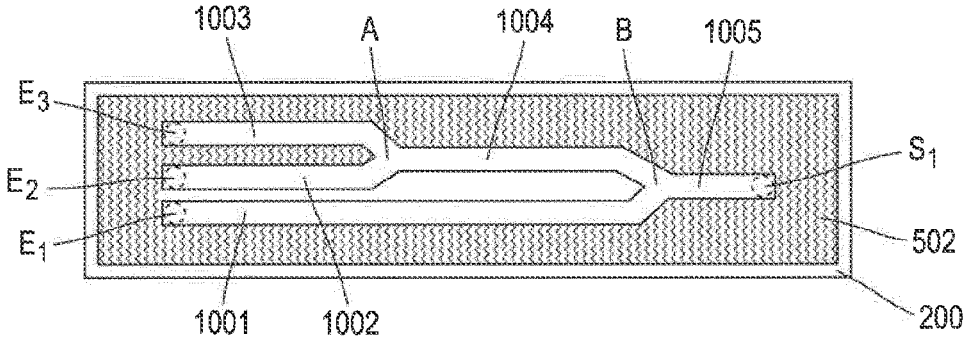
[Fig. 9]
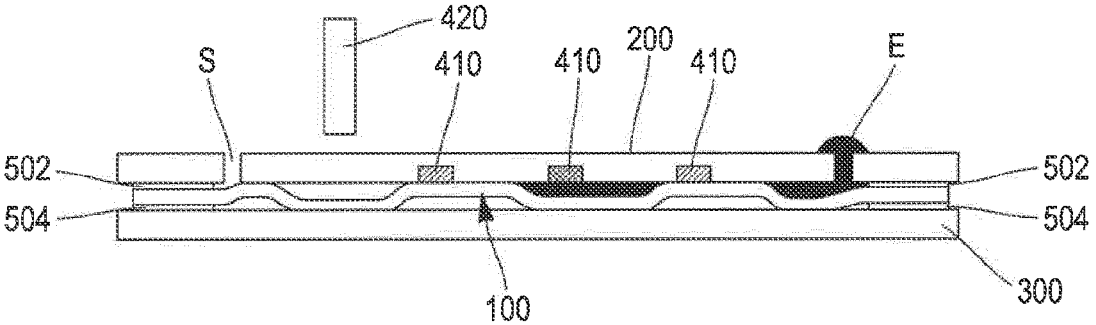
[Fig. 10]
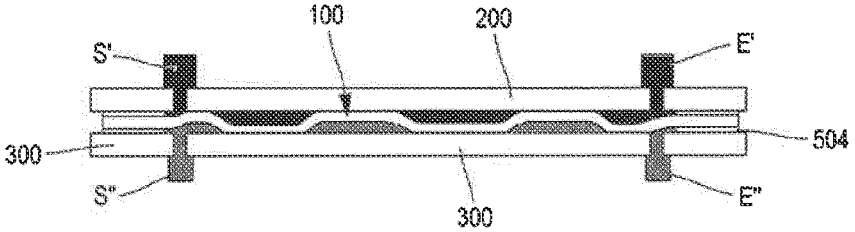

PUMPING SYSTEM IN THE LAB-ON-A-CHIP FIELD

CROSS-REFERENCE TO RELATED APPLICATIONS

The present application is a filing under 35 U.S.C. 371 as the National Stage of International Application No. PCT/EP2020/075379, filed Sep. 10, 2020, entitled "PUMPING SYSTEM IN THE LAB-ON-A-CHIP FIELD," which claims priority to European Application No. 1910252 filed with the Intellectual Property Office of France on Sep. 17, 2019, both of which are incorporated herein by reference in their entirety for all purposes.

TECHNICAL AREA

The present invention relates to a system for pumping a fluid and a method of implementing this system.

More specifically, the invention relates to a system for pumping a fluid in the field of lab-on-chip applications.

STATE OF THE ART

The controlled handling of fluids by pumps is necessary in many fields. For example, such controlled manipulation is implemented in the field of labs-on-a-chip. This field consists of miniaturizing, on a chip, laboratory functions.

For this, systems are typically used to pump and control the flow rate and pressure of fluids circulating inside the chip in order in particular to be able to perform various functions such as dissolving powder or bringing several fluids into contact and mixing them, for example to analyze a sample in order to assay a desired substance. The fluid drive system can be more or less integrated depending on the need and the existing solutions. In some cases, the pumping can be performed by a system completely external to the chip, such as for example a syringe pump system with its syringe, a conventional peristaltic pump system, a system using the difference in height allowing the use of the force of gravity, or even a pneumatic pressure control system exerting air pressure on the fluid to be injected. These systems require the fluid to pass between the exterior of the chip and the interior, which involves making sealed connections between the chip and the external equipment.

This poses problems of compactness, sealing, ease of use, sterility, waste of the fluid contained in the connecting pipes and sometimes even precision because of the deformation of the connecting pipes. This is why it is useful to integrate into the chip the pumping elements which are in direct contact with the fluid and which make it possible to transmit to it the energy at the origin of its displacement, while possibly being able to leave other parts of the pumping system outside the chip. A large number of technologies are proposed in the literature or industry. The capillary force is used by controlling the hydrophilic character of the channels in the chip. As this technique is passive, it does not allow the pumping to be controlled from the outside, moreover, it depends on the fluid used. Electrokinetic or magnetokinetic forces acting directly on the liquid can be used, including electroosmotic forces, but flow control is complex, the force depends on the fluid used, and fluids can be chemically affected and denatured. Centrifugal force is used in particular on chips set in rotation, but as the chip rotates, it is complicated to simultaneously perform certain actions such as a measurement or an injection, furthermore, the pumping cannot be performed continuously.

The drive of the fluid by displacement of a wall of a channel or a chamber of the chip is the most widespread technique: this is traditionally done thanks to deformable walls by pneumatic or solid pressure or thanks to sliding walls in mini-syringes activated by pressure of a solid. Nevertheless, depending on their implementation, these latter systems require either the additional integration of pneumatic channels and connections in the chip, or the integration of passive valves whose direction of circulation of the liquid cannot be modified, or the integration active valves requiring several external actuators to activate a single pump, or the integration of mini-syringes that must be assembled and sealed. In addition, it is often necessary to couple the integrated part of the pump with the non-integrated part by precise positioning and mechanical support of the chip on the actuators, which constrains the geometry, materials and positioning of the chip.

Thus, the pump systems currently used in this field fail to combine numerous advantages at the same time, such as low integration and industrialization costs, versatility, robustness, precision and a large operating range. Thus, no solution stands out to effectively address the problem of pumping fluids in labs on chips, and in particular for medical diagnostics which requires a disposable, low-cost, precise, robust solution that can generate overpressure or vacuum, and simple and reliable to use.

Furthermore, it should be noted that pumps, not intended for laboratories on chips, currently exist and use a wave motion of a magnetically charged membrane to create cavities capable of moving, the membrane only managing to deform into wavelets by the application of forces whose orientation and intensity vary according to location and time. However, the application of these forces which are heterogeneous and progressive can only be exerted, on a membrane without heterogeneous magnetic structure, by the application of a magnetic field whose orientation and/or gradient is heterogeneous spatially and varying over time. This forces the use of multiple field sources placed in the immediate vicinity of the membrane and of a dimension similar to the dimension of the ripples, which is often small (a few millimeters). In addition, these sources must be modular. Generally, these sources comprise several small electromagnets integrated into a support. However, such pumps have drawbacks in particular related to the fact that the electromagnets clutter up the support and heat up by the Joule effect close to the pumped liquid. Moreover, the integration of the electromagnets is expensive and the dimension of the wavelets is limited in miniaturization. It is also necessary to have a contact connection with an electrical source and a control circuit to modulate each electromagnet. This is why this type of pump is not suitable for labs-on-chips.

DESCRIPTION OF THE INVENTION

To solve one or more of the aforementioned drawbacks, an object of the invention relates to a system for pumping a fluid, the system comprising:

- a pump comprising:
  - an inlet and an outlet for respectively introducing and extracting the fluid capable of being pumped,
  - a flexible membrane having two opposite surfaces, the membrane comprising a spatially rotating permanent magnet structure,
  - a rigid support means on which is fixed a part at least of said surfaces of the membrane, a source of a magnetic field capable of generating a driving magnetic field at the place where the membrane is located, said driving magnetic field having a substantially homogeneous orientation, the membrane being capable of deforming, under the effect of the driving magnetic field, according to a ripple having alternately one or more concave parts and one or more convex parts, the ripple being able to move under the effect of the field magnetic drive, the fluid capable of being pumped between the inlet and the outlet being located at least between one of said surfaces of the membrane and the support means.

By fluid is meant, within the meaning of the present invention, a gas, a liquid or a mixture of gas and/or liquid.

By flexible membrane is meant, within the meaning of the present invention, a membrane capable of being deformed in a reversible and elastic manner, and whose Young's modulus is sufficiently low for the magnetic stresses applied in the membrane to be sufficient to generate the deformation of the membrane. The Young modulus can for example be between 100 kPa and 1 GPa.

By spatially rotating permanent magnetization structure is meant, within the meaning of the present invention, a magnetization structure consisting of a juxtaposition of elementary zones, these elementary zones having a variation of rotating magnetization according to the axis of the desired displacement of the ripple.

For example, to understand, according to the present invention, if we are dealing with a "spatially rotating permanent magnet structure", the following protocol is followed:

a. the term "elementary zone" is defined as being a volume portion of the membrane, in particular the part of the membrane free to deform and create the ripple, over its thickness and its width and whose length is limited to twice the thickness of the membrane, b. the membrane is partitioned into elementary zones Zn, n being the index numbering the consecutive elementary zones one after the other in the increasing direction of their scrolling from left to right for an observer looking at a membrane placed horizontally in section along the cutting plane PP, also called the plane of magnetic rotation of the membrane, the lower surface of which is located on the bottom side of the membrane, the plane PP being the plane perpendicular to the membrane and containing the ES Axis (Entrance to Exit) corresponding to the desired ripple displacement axis, c. we note $A_n$ the average magnetization of the elementary zone $Z_n$ projected on the plane PP, d. we note $O_n$ the oriented angle belonging to $[-\pi, \pi]$ representative of the angle between An and An+1, e. it is then considered that the permanent magnetization structure is spatially rotating if the following two conditions are met:

i. for all n, $O_n$ is positive, or else for all n, $O_n$ is negative. We note in passing that for the following, in the case where $O_n$ is positive, that is to say in the case where the spatially rotating permanent magnetization structure of the membrane rotates, from left to right, in the direction trigonometric, then we will name the upper surface, that is to say the surface exposed upwards, the strong surface and the lower surface, that is to say the surface exposed downwards, the weak surface, and in the case where $O_n$ is negative, that is to say in the case where the spatially rotating permanent magnetization structure of the membrane rotates, from left to right, in the anti-trigonometric direction, then we will name the surface upper the weak surface and lower surface the strong surface ii. for all n, the absolute value of $O_n+O_{n+1}$ is less than $5\pi/3$ iii. the magnetization makes at least one turn, i.e. the sum over all the n of the $O_n$ makes at least $2*\pi$ For the following, we call "magnetic pattern" any part of a membrane corresponding to a magnetization performing a turn, that is to say the smallest part such that the sum of the $O_n$ is greater than $2*\pi$. The "length of the pattern" is the length of the magnetic pattern in the magnetization rotation direction, that is to say the period of spatial rotation of the magnetization of the membrane.

Magnetic rotation plane of the membrane means, within the meaning of the present invention, a plane perpendicular to a spatial axis of rotation of the rotating magnetization of the membrane.

The magnetizable nature of the membrane is obtained by any means known to those skilled in the art. For example, this character comes from a mixture between magnetizable magnetic particles and a flexible polymer during the manufacture of the membrane. The membrane is magnetized by any method known to those skilled in the art to form the rotating magnetization structure.

By temporally rotating driving magnetic field is meant, within the meaning of the present invention, a magnetic field whose orientation is in rotation in space, this rotation possibly being continuous or discontinuous.

For example, to understand, according to the present invention, if a driving magnetic field B is a "time-rotating driving magnetic field", the following protocol is followed:

a. the term "elementary temporal zone" is defined as being a portion of time which allows a significant dynamic evolution of the membrane allowing it to pass from its initial deformation to its equilibrium deformation when it is subjected to a change in stress, b. the time is partitioned into elementary time zones $Zt_n$, n being the index numbering the consecutive elementary time zones in the direction of the passage of time, c. we note $B_n$ the magnetic field B averaged on $Zt_n$ and projected on the PP plane, d. we note $Ob_n$ the oriented angle belonging to $[-\pi, \pi]$ which measures the angle from Bn to Bn+1, e. It is then considered that the driving magnetic field is temporally rotating if the following two conditions are met:

i. for all n, $Ob_n$ is positive, or else for all n, $Ob_n$ is negative. We note in passing that for the sequel, in the case where $Ob_n$ is positive, we will say that B rotates counterclockwise, and in the case where $Ob_n$ is negative, we say that B rotates anti-trigonometrically ii. for all n, the absolute value of $Ob_n+Ob_n+i$ is less than $\pi/2$ By temporally rotating driving magnetic field having a substantially homogeneous orientation is meant, within the meaning of the present invention, a magnetic field whose orientation dispersion is less than 45° over the zone of the magnetic pattern of the membrane.

Furthermore, note that:

if the driving magnetic field rotates counterclockwise, and the strong surface of the membrane is the upper surface, then the movement of the ripple will be to the right if the driving magnetic field rotates in the anti-trigonometric direction, and the strong surface of the membrane is the upper surface, then the movement of the ripple will be to the left if the driving magnetic field rotates counterclockwise, and the strong surface of the membrane is the lower surface, then the displacement of the ripple will be to the left if the driving magnetic field rotates in the anti-trigonometric direction, and the strong surface of the membrane is the lower surface, then the movement of the ripple will be to the right.

It should be noted that the fluid is therefore capable of circulating between the inlet and the outlet by peristaltic effect.

According to the invention, the quantity $mBT^2/(Eh^2)$ must be greater than 0.01, where m is the mean of the intensity of the magnetization in the membrane (for example in A/m), B the intensity of the magnetic field generated by the source in the membrane (for example in T), E the Young's modulus (for example in Pa), h the thickness of the membrane (for example in m) and T the period of spatial rotation of the magnetic pattern of the membrane (for example in m).

Preferably, the average intensity of the magnetization in the membrane m can be between 10 kA/m and 1,000 kA/m, advantageously between 100 kA/m and 500 kA/m, even more advantageously between 200 kA/m and 400 kA/m.

Preferably, the intensity of the magnetic field B at the level of the pump can be between 10 mT and 1 T, advantageously between 50 mT and 500 mT, even more advantageously between 70 mT and 150 mT Preferably, the magnetization structure can be defined by a spatial rotation period comprised between 20 μm and 2 cm, advantageously between 50 μm and 1 cm, even more advantageously between 500 μm and 5 mm, even more advantageously between 1 mm and 3 mm.

Preferably, the Young's modulus E can be between 100 kPa and 1 GPa, advantageously between 500 kPa and 500 MPa, even more advantageously between 900 kPa and 5 MPa.

Preferably, the membrane may have a thickness comprised between 5 μm and 1 cm, advantageously between 50 μm and 300 μm, even more advantageously between 100 μm and 200 μm. Thus, the pump has a reduced thickness in order to then allow efficient integration in any chip, for example.

Thus, thanks to the system according to the invention, the pumping function is entirely performed by a membrane without it being necessary to use one or more valves. Moreover, thanks to the system according to the invention, the pumping function is ensured by the creation and the translation of separate chambers, each of these chambers being formed by the application of the temporally rotating driving magnetic field. The direction of the pumping can be chosen according to the direction of rotation of the magnetic field. In addition, two membranes located in the same rotating driving magnetic field will be able to see the displacement of their ripple take place in opposite directions if the orientation of the strong and weak surfaces of the membranes is opposite. Furthermore, the system makes it possible to perform pumping which is not susceptible to bubble phenomena insofar as this system is capable of pumping both a liquid and a gas. Using the system according to the invention, it should be noted that it is possible to modify the flow rate or the direction of circulation of the fluid located in the pump by modulating only the speed and the rotation direction of the magnetic field rotating drive. Furthermore, the invention also has the advantage of not necessarily releasing heat by the Joule effect near the pumped liquid because, on the one hand, it is possible to use a permanent magnet rather than electromagnets to generate the drive field, and on the other hand, even in the case where it would be an electromagnet, it is possible to place them at a distance from the channel to avoid heating it.

Preferably, a projection of the driving magnetic field on the plane of magnetic rotation of the membrane can be capable of rotating temporally.

Preferably, the driving magnetic field can be entirely included in the plane of magnetic rotation of the membrane.

Preferably, at least one or more of the convex parts may be capable of being in contact with the support means and at least one or more of the concave parts may be capable of not being in contact with the support so as to allow the formation of one or more chambers between one of said surfaces of the membrane and the support means, these chambers being capable of receiving a fluid, and the displacement of the ripple making it possible to create the displacement of the chambers and therefore the displacement of the fluid between entry and exit.

One or more of the convex parts being in contact with the support means, within the meaning of the present invention, means at least part of one or more of the vertices of the convex parts in contact with the support means.

Preferably, the temporally rotating driving magnetic field may also have a minimum gradient of 1 T/m and an orientation of the gradient that is substantially homogeneous.

Preferably, the temporally rotating driving magnetic field may also have a minimum gradient of 1 T/m and an orientation of the gradient which is constant over time.

Preferably, when the temporally rotating driving magnetic field exhibits a minimum gradient of 1 T/m, a substantially homogeneous gradient orientation and a constant gradient orientation over time, the membrane can be positioned such that the gradient is oriented from the weak surface to the strong surface, given that:

when the spatially rotating permanent magnet structure of the membrane rotates, from left to right, in the counterclockwise direction, the strong surface designates the surface exposed upwards and the weak surface designates the surface exposed downwards, and when the spatially rotating permanent magnet structure of the membrane rotates, from left to right, in the anti-trigonometric direction, the strong surface designates the surface exposed downwards and the weak surface designates the surface exposed upwards.

Preferably, the pump and the source of a magnetic field may not be in contact. Thus, no material connection is necessary between the membrane and the source of a magnetic field which makes it possible to be able to activate the pump remotely: the source being located outside of a chip which can include the pump.

Preferably, the membrane can comprise a polymer and a magnetic material, the magnetic material comprising the magnetic particles allowing the magnetization structuring. Even more preferably, the membrane may be biocompatible.

According to a first variant embodiment of the system according to the invention, the system may further comprise a rigid wall fixed on at least part of the perimeter of the other of said surfaces of the membrane and spaced from the membrane by a distance d sufficient to allow ripple and to allow contact between the concave parts and the wall. This has the effect of increasing the strength and the bearing surface of the membrane on the support means by presenting it with a bearing wall, of improving the control of the volume of fluid contained in each convex part and also of allowing the protection of the membrane from potential shocks or friction that could damage it.

According to a second variant embodiment of the system according to the invention, the system may comprise a rigid wall fixed on at least part of the perimeter of the other of said surfaces of the membrane and spaced from the membrane by a distance of sufficient to allow corrugation and to avoid contact between the concave parts and the wall. Thus, it is possible, in addition to the effects mentioned for the first variant, to apply a predefined pressure to the surface of the membrane which is not in contact with the fluid.

Rigid wall fixed on at least part of the perimeter of the other of said surfaces of the membrane, within the meaning of the present invention, means at least part of the perimeter of the other of said surfaces of the membrane which is immobile with respect to the rigid wall and connected to it directly or indirectly.

Preferably, the wall may comprise an orifice through which a controlled pressure is applied between the wall and the membrane. Thus, it is possible to apply to the surface of the membrane which is not in contact with the fluid to be pumped a pressure which is controlled so as to avoid altering the membrane or even the pumped fluid and also to accentuate the support of the membrane against the support means.

Preferably, the membrane may have two through orifices, each being located at its ends so that the fluid capable of being pumped is also located between the other of said surfaces of the membrane and the wall. Thus, it is possible to have a flow of fluid in the pump that is higher and more constant than when there is an absence of these two through orifices insofar as the fluid then circulates both in the concave parts but also in the convex parts. Indeed, the pump is then arranged so that the fluid circulates both between the membrane and the support means and between the membrane and the wall to increase the flow rate and the regularity of the circulation of the fluid in the pump. Moreover, the fluid circulating on either side of the membrane, the pump is only influenced by the pressures at the inlet and at the outlet of the pump, freeing itself from the ambient pressure. Its flow and regularity are therefore improved.

Preferably, the wall may further comprise a second inlet and a second outlet for respectively introducing and extracting a pumpable fluid further located between the other of said surfaces of the membrane and the wall. The fluid capable of circulating between the other surface of the membrane and the wall can either be the same as that capable of circulating between one of said surfaces of the membrane and the support means, or be different. In the case where the same fluid is capable of circulating on either side of the membrane, it is possible for the inlet of the support means and the second inlet of the wall to be connected by a channel. It is the same for the output of the support means and the second output of the wall. In this way, the pump is only influenced by the pressures at the inlets and outlets of the pump, independent of the ambient pressure. It also improves its flow and its regularity.

It should be noted that the support means and/or the rigid wall may be transparent so as to be able to observe the various chambers formed by the ripple and/or to allow only desired and predefined radiation to pass.

It should also be noted that the support means and/or the wall can comprise a measuring device (such as a sensor) and/or an actuator which can be in direct contact with the fluid.

It should be noted that the system according to the invention can also be used in fields such as compressors, vacuum pumps, the circulation of electrolytes in a cell, the driving of cooling liquid.

Furthermore, another object relates to a method for implementing a system described above and comprising the following steps:

a) interaction between the driving magnetic field from the source and the permanent magnetization structure of the membrane so as to create stresses in the membrane causing a static deformation of the membrane following a ripple having alternately one or more concave parts and one or more convex parts, b) rotation of the driving magnetic field so as to displace the stresses in the membrane to move the ripple in an orientation defined according to the direction of rotation of the driving magnetic field, c) displacement of the fluid between the inlet and the outlet, the fluid being comprised at least in one of the concave parts delimited by the membrane and the support means.

Preferably, rotation step b) can be carried out by rotating a permanent magnet.

Preferably, when the temporally rotating driving magnetic field has an orientation of the gradient which is substantially spatially homogeneous and constant, the gradient can be directed from the weak surface towards the strong surface of the membrane.

Furthermore, it should be noted that the present invention has many advantages capable of solving the problems of labs-on-a-chip but is not limited thereto. Thus, a multitude of other applications are possible, such as the circulation of electrolytes in an electric battery, the distribution or metering of fluid products (for example medicine), the creation of vacuum or overpressure in containers by example for their preservation, the circulation of a cooling liquid on an electronic card. It is also conceivable to implant the pump in a biological medium such as the human body in order to release a drug or withdraw/transfer a fluid.

BRIEF DESCRIPTION OF THE FIGURES

The invention will be better understood on reading the following description, given solely by way of example, and with reference to the appended figures in which:

FIG. 1 represents a system according to an embodiment according to the invention, FIG. 2A represents a membrane comprising a spatially rotating permanent magnetization structure according to an embodiment according to the invention, [FIG. 2B] represents a membrane comprising a spatially rotating permanent magnetization structure according to an embodiment according to the invention, [FIG. 3A] represents the reaction of the membrane according to an embodiment according to the invention to the driving magnetic field;

FIG. 3B represents the reaction of the membrane according to an embodiment according to the invention to the driving magnetic field;

FIG. 3C represents the reaction of the membrane according to an embodiment according to the invention to the driving magnetic field;

FIG. 4A shows a top view of a system (hereinafter referred to as the first system) according to a first embodiment according to the invention;

FIG. 4B shows a sectional view of the system according to the first embodiment according to the invention when the latter is activated;

FIG. 4C shows a sectional view of the system according to the first embodiment according to the invention when the latter is activated;

FIG. 4D shows a sectional view of the system according to the first embodiment according to the invention when the latter is activated;

FIG. 4E shows a sectional view of the system according to the first embodiment according to the invention when the latter is activated;

FIG. 5 shows a sectional view of a system (hereinafter referred to as the second system) according to a second embodiment according to the invention;

FIG. 6 shows a sectional view of a system (hereinafter referred to as the third system) according to a third embodiment according to the invention;

FIG. 7 shows a sectional view of a system (hereinafter referred to as the fourth system) according to a fourth embodiment according to the invention;

FIG. 8 shows a sectional view of a system (hereinafter referred to as the fifth system) according to a fifth embodiment according to the invention;

FIG. 9 shows a sectional view of a system (hereinafter referred to as the sixth system) according to a sixth embodiment according to the invention; and [FIG. 10] shows a sectional view of a system (hereinafter referred to as the eighth system) according to an eighth embodiment according to the invention.

EMBODIMENTS

FIG. 1 shows a system according to an embodiment according to the invention. This system includes:

a pump 1 through which at least one fluid can circulate between an inlet E and an outlet S, and a source 2 of a magnetic field capable of generating in a membrane 100 a temporally rotating magnetic drive field 2A, having a minimum gradient of 1 T/m and an orientation of the gradient that is substantially spatially homogeneous in the membrane 100 and whose orientation of the gradient is constant over time, this source 2 being for example a permanent magnet set in rotation but can also be any sources known to those skilled in the art.

In FIG. 1, the lines of the magnetic drive field 2A resulting from the source 2 can be seen. The driving magnetic field is generated by a local source located close to the pump 1, in particular its membrane 100, a situation quite advantageous due to its simplicity of implementation. Indeed, typically, this source 2 of a driving magnetic field can, for example, be a set of electromagnets or a permanent magnet set in rotation on itself.

FIGS. 2A and 2B illustrate at least in part a spatially rotating permanent magnetization structure of the membrane 100. In these figures, there is a repetition of a magnetic pattern, having a spatial rotation period T, in the membrane 100 so that the membrane 100 can ripple under the effect of the magnetic field. It should be noted that this pattern is only given as an indication and the spatial rotation period T can vary according to the desired applications so as to have ripples of greater or lesser periods.

In particular, and by way of example, to define the spatially rotating permanent magnetization structure of FIG. 2 which presents an example of a magnetic pattern of the membrane 100:

a. the term "elementary zone" is defined as being a volume portion of the membrane 100, b. the membrane 100 is partitioned into elementary zones $Z_n$, in the example in FIG. 2A, there are 15 elementary zones numbered consecutively one after the other in the increasing direction of their scrolling from the left to the right for an observer looking at the membrane 100 ($Z_0<Z_n<Z_{15}$), the plane PP being the plane perpendicular to the membrane 100 and containing an axis connecting the inlet E and the outlet S of the pump 1 which corresponds to a desired ripple movement axis, c. we note $A_n$ the average magnetization of a particular elementary zone $Z_n$ projected on the plane PP, d. we note $O_n$ the oriented angle belonging to $[-\pi, \pi]$ representative of the angle between $A_n$ and $A_{n+1}$, e. the permanent magnetization structure is spatially rotating because for all n ($0<n<15$), $O_n$ is positive, the surface exposed to the top of the membrane 100 is the strong surface 10011 and the surface exposed to the bottom of the membrane 100 is the weak surface 10012, and for all n, the absolute value of $O_n+O_{n+1}$ is approximately equal to tt/4, and the magnetization makes at least one turn, that is to say that the sum over all the n, of a period of spatial rotation T, the $O_n$ makes at least $2*\pi$.

FIGS. 3A, 3B and 3C illustrate the reaction of the membrane 100 of the pump 1 in FIG. 1 to the driving magnetic field 2A which is applied to it so that a fluid chamber F circulates through the pump 1 between input E and output S. In this configuration, if the driving magnetic field rotates in the anti-trigonometric direction, the strong surface 10011 of the membrane 100 being located upwards, then the displacement of the ripple takes place towards the left.

The driving magnetic field 2A at the level of the membrane 100 typically has an orientation of its gradient 2B that is substantially homogeneous and constant over time, this gradient 2B being generally oriented towards the source 2. It should be noted that the gradient 2B generates a resulting magnetic force 100B linked to the gradient 2B in the membrane 100 which is equal to $F_m$=grad(MB). If the gradient 2B of the driving magnetic field 2A is high, this magnetic force 100B must be taken into account in the deformation of the membrane 100. It is then no longer possible to take into account only the magnetic torque ($C_m$=M×B) 100A resulting in the membrane 100 generated in the membrane 100 to explain the deformation of the latter, as in the case of FIG. 3A, it is also necessary to take into account the magnetic force 100B $F_m$. (see FIGS. 3B and 3C).

However, the effect of this magnetic force 100B resulting from the gradient 2B can accentuate or disadvantage the deformation of the membrane 100 caused by the torque 100A $C_m$, depending on whether the gradient 2B is oriented in the direction [weak surface 10012]=>[strong surface 10011](FIG. 3B) or in the direction [strong surface 10011] =>[weak surface 10012] (FIG. 3C).

In the first case, i.e. in the direction [weak surface 10012]=>[strong surface 10011], the magnetic force 100B promotes the deformation of the torque 100A, as can be seen in the example shown in FIG. 3B (membrane 100+gradient 2B), where the magnetic force 100B $F_m$ has been indicated by arrows superimposed on the deformation of torque 100A in FIG. 3A, $F_m$ both to cause the maximum altitude points of the membrane 100 towards the strong surface 10011 (or upwards), and the minimum altitude points towards the weak surface 10012 (or downwards).

In the second case, that is to say in the direction [strong surface 10011]=>[weak surface 10012], the magnetic force 100B disadvantages the deformation of the torque 100A, as can be seen in the example shown in FIG. 3C (membrane 100+gradient 2B, where the magnetic force 100B $F_m$ has been indicated by arrows superimposed on the torque deformation 100A in FIG. 3A: $F_m$ both to cause the points of maximum altitude of the membrane 100 towards the weak surface 10012 (or downwards), and the points of minimum altitude towards the strong surface 10011 (or upwards).

Thus, even in the case where the temporally rotating driving magnetic field 2A also has a strong substantially homogeneous gradient 2B and whose orientation is constant, it is possible to maintain adequate deformation of the membrane 100 by orienting the latter so as to that it exposes its strong surface 10011 to the zones of strong magnetic driving field 2A, that is to say on the side of the source 2.

FIGS. 4A, 4B, 4C, 4D and 4E show a pump according to a first system according to a first embodiment according to the invention, the pump comprising:

- an inlet E and an outlet S for respectively introducing and extracting the fluid from the pump,
- a flexible membrane 100 having an upper surface 102 and a lower surface 104, the membrane 100 comprising a spatially rotating permanent magnet structure, and
- a rigid support means 200 to which is fixed at least part of the perimeter of the lower surface 104 of the membrane 100.

The source of the magnetic field then generates the driving magnetic field at the place where the membrane 100 is located. The projection of the driving magnetic field onto a magnetic rotation plane PP of the membrane 100, having a substantially homogeneous orientation and having temporally rotating components in the magnetic rotation plane PP, is likely to be temporally rotating. It should be noted that the driving magnetic field can also be entirely included in the magnetic rotation plane PP of the membrane 100.

Thus, the driving magnetic field and the permanent magnetization structure interact so as to create stresses in the membrane 100 to generate a static deformation of the membrane 100 following an ripple presenting alternately one or more concave parts and one or more convex parts. In this way, the rotation of the driving magnetic field applied to the membrane 100 allows the displacement of the stresses in the membrane 100 to move the ripple in an orientation defined by the driving magnetic field rotation direction.

The inputs and outputs of this first embodiment of the system according to the invention are made by creating holes made in the support means 200, by infiltration through the support means 200, or even by introducing channels arranged between the membrane 100 and the support means 200. The same is true for the other embodiments of the system according to the invention.

The support means 200 makes it possible to enhance the ripple movement of the membrane 100 to transport the fluid.

The pump and the source of the magnetic field are not in contact in this embodiment. Thus, no material connection is necessary between the membrane 100 and the source of a magnetic field, which makes it possible to be able to activate the pump remotely.

For example, the support means 200 can comprise glass, silicon, PDMS, PMMA, COP, polycarbonate, polyimide, PVC or even PE.

It should be noted that the source of a magnetic field then allows the creation of the ripple of each of the membranes 100 represented in the figures.

This magnetic field source can, for example, be a rotating cylindrical magnet or comprise electric coils placed close to the pump, but without contact or connection with it. The source can also comprise an electromagnet, a non-cylindrical magnet or Halbach cylinder, a cylindrical magnet or one not associated with a DC motor or with one or more electric coils.

It should be noted that part of the convex parts, therefore parts of the lower surface 104 of the membrane 100, are in contact with the support means 200 so that one or more of the concave parts contain a volume of fluid, or chamber of fluid, the volume of fluid being able to move on the support means 200 between the inlet E and the outlet S during the movement of the ripple.

The membrane 100 comprises a mixture comprising a polymer and a magnetic material. For example, the mixture is a homogeneous mixture of a flexible polymer, such as PDMS, latex, or even silicone, with powder of a hard magnetic material having, for example, a particle size of 30 μm, such as an NdFeB powder or else such as a ferrite powder. Furthermore, it is possible to obtain a biocompatible membrane composed of biomaterials.

For example, this membrane 100 can be manufactured as indicated below. Once the mixture has been spread and polymerized then cut according to the shape of the support means 200 on which it will be placed for example, the membrane obtained is magnetized so as to have a spatially rotating permanent magnetization capable of causing the ripple in the membrane 100 by the action of the temporally rotating driving magnetic field on the magnetization of the membrane 100. The membrane 100 then has sufficient flexibility to allow the creation of the ripple.

For example, the membrane 100 manufactured as indicated above can have a magnetization structure defined by a spatial rotation period T approximately equal to $1.10^{-3}$ m, having a Young's modulus E approximately equal to $1{\cdot}10^{5}$ Pa and a thickness h approximately equal to $1{\cdot}10^{-4}$ m.

For example, the average of the intensity of the magnetization m in the membrane can be approximately equal to $1{\cdot}10^{5}$ A/m, the intensity of the magnetic field B generated by the source of the magnetic field in the membrane 100 can be approximately equal to $1{\cdot}10^{-2}$ T.

In this configuration, the quantity $mBT^2/(Eh^2)$ is then equal to 1.

Thus, the heart of the pump rests in particular on a flexible membrane 100 with spatially rotating permanent magnetization. It should be noted that the displacement of the ripple allows the peristaltic drive of the fluid through the pump. The membrane 100, which is low cost, can therefore, in the field of labs-on-a-chip, easily be placed in a chip directly during manufacture and therefore operate in a device isolated from the power source of the pump. The pump can then be activated through rigid elements simply by positioning it near the source of the magnetic field. Also, the pump can be implanted in a body or a biological medium while the source of the magnetic field can itself be located outside.

FIG. 4A shows a top view of the pump included in the system according to the first embodiment. The fixing means 502 used to fix the perimeter of the lower surface 104 of the membrane 100 to the rigid support means 200 can be any of those known to those skilled in the art and allowing the pump to be sealed.

FIG. 4B illustrates the state of the pump when no magnetic field is applied to it.

FIG. 4C illustrates the state of the pump when the magnetic field is applied to it. It can be noted that in FIGS. 4C, 4D and 4E is connected to the inlet E a volume of fluid that one wishes to transmit to the outlet S. For example, the pressure applied to the inlet E of the pump can be approximately 1,013 hPa, that at the outlet S approximately 1,063 hPa, and that on the outer side of the membrane 100 (in contact with the upper surface 102) of 1,013 hPa.

This transmission is achieved through the formation of the ripple and its movement from the input E to the output S. Thus, the volume of fluid is introduced into the pump through the inlet E and is transmitted into the concave part connected to the inlet E, this concave part forming a pocket delimited by the membrane 100 which has the ripple and the support means 200 (FIG. 4C). Then, under the action of the rotation of the magnetic field, the ripple moves from the entrance E towards the outlet S to also displace the volume of fluid contained in the pocket (FIG. 4D). As soon as a second concave part is connected to the inlet E, another volume of fluid is introduced into it so that several volumes of fluid move simultaneously between the support means 200 and the membrane 100 (FIG. 4E). It should be noted that each of these concave parts, or pocket or chamber, can contain a predefined volume of fluid comprised between 10 nL and 1 mL, for example 1 μL, which is in particular a function of the geometric characteristics of the pump 1.

The flow rate of fluid circulating in the pump according to the first embodiment varies according to the application of the magnetic field, and in particular the speed of rotation of the magnetic field. Each time the magnetic field completes a full rotation, the ripple moves by the spatial rotation period of the magnetic pattern.

Referring to FIG. 5, a second system according to a second embodiment according to the invention is shown.

The pump of this second embodiment differs from that of the first embodiment in that it further comprises a rigid wall 300 fixed on at least part of the perimeter of the upper surface 102 of the membrane 100 and spaced from the membrane 100 by a distance d sufficient to allow the ripple and to allow contact between the concave parts and the wall 300. This distance d can be between 10 pm and 1 cm. The rigid wall 300 is fixed on the perimeter of the upper surface 102 of the membrane 100 using fixing means 504 known to those skilled in the art similar to those used for fixing the perimeter of the membrane 100 to the support means 200.

Furthermore, the rigid wall 300 includes an orifice 302, but could include several (not shown in the figures), through which a controlled pressure is applied between the wall 300 and the membrane 100. This pressure is brought for example by the entry through the orifice 302 of a gas or a fluid.

Referring to FIG. 6, a third system according to a third embodiment according to the invention is shown.

According to the third embodiment, the pump comprises a rigid wall 300 fixed on at least part of the perimeter of the upper surface 102 of the membrane 100 and spaced from the membrane 100 by a distance d' sufficient to, unlike the pump of the second mode, allow ripple and to avoid contact between the concave parts and the wall 300. The rigid wall 300 is fixed on the perimeter of the upper surface 102 of the membrane 100 using fixing means 504 known to those skilled in the art similar to those used for fixing the perimeter of the membrane 100 to the support means 200. The distance d' is at least equal to the thickness of the membrane 100. In this embodiment, the membrane 100 does not rest on the wall 300, as in the second embodiment, but on a fluid or gas introduced between the membrane 100 and the wall 300 via the orifice 302 which applies a pressure on the membrane 100 and of which it is possible to modulate the pressure.

Referring to FIG. 7, a fourth system according to a fourth embodiment according to the invention is shown.

In this fourth mode, the pump is similar to that of the second mode but comprises a membrane 100 having two through orifices 106 and 108, each being located at its ends, as well as the wall 300 without an orifice. Thus, it is possible to have a higher and more constant flow of fluid in the pump than when there is no presence of these two orifices 106 and 108 insofar as the fluid then circulates both in the concave parts but also in the convex parts. Indeed, the pump is then arranged so that the fluid circulates both between the membrane 100 and the support means 200 and between the membrane 100 and the wall 300 to double the circulation rate of the fluid in the pump. Thus, rather than having at the outlet S an interspersed flow of fluid, here since the volumes of fluid are contained both in the concave and convex parts, the flow at the outlet S is more constant. Furthermore, this fourth embodiment makes it possible to overcome the influence of the pressure outside the pump: only the inlet pressure $P_0$ and the outlet pressure $P_s$ are to be considered. Moreover, the pressure obtained in a chamber is obtained by the pressure of the preceding chamber to which is added the addition of pressure generated by the part of the membrane between the two chambers. Thus, it is possible to increase the possible pressure difference between the inlet of the pump and the outlet of the pump during its manufacture by increasing the number of ripples in the pump (and therefore of magnetic patterns in the membrane 100).

Furthermore, for this embodiment, but also for the others, the rigid support means 200 can comprise a channel with rounded side edges (not shown in the figures) connecting the inlet E to the outlet S to guide the fluid circulating in the pump between inlet E and outlet S. In this way, sealing is ensured. Furthermore, the channel may have a thickness of 350 μm.

Referring to FIG. 8, a fifth system according to a fifth embodiment according to the invention is shown.

This fifth system comprises a pump having several inlets E1, E2 and E3 and a single outlet S1. The pump then consists of a single membrane having several parts, three in this case: a first part 1001 connecting the inlet E1 to a point B, a second part 1002 connecting the input E2 to a point A, a third part 1003 connecting the input E3 to the point A, a fourth part 1004 connecting the point A to the point B and a fifth part 1005 connecting the point B at the output S1. The magnetic patterns of each of these parts are in phase at the points A and B so that there is indeed the creation of a single chamber at the intersection points A and B. Furthermore, are associated with each of these parts 1001, 1002, 1003, 1004, 1005 of the channels to guide the fluids flowing in each of these parts. The single membrane made up of these different parts forms a monobloc.

Using this fifth system, it is possible to introduce different fluids into each of the inlets E1, E2 and E3, to mix them at points A and B, and to recover the mixture at the outlet S1.

In this fifth system, the fluid introduced into each of the inlets E1, E2 and E3 is constantly stored in a chamber respectively of the first part 1001, second part 1002 and third part 1003, without leaks in the other chambers which follow or precede. Thus, two chambers from two different parts, for example a chamber from the second part 1002 and another chamber from the third part 1003, can merge together into a larger chamber at point A, and this larger chamber can merge with another chamber from the first part 1001 at point B.

It should be noted that by changing the circulation direction of the pumped fluid, the inputs E1, E2 and E3 can become outputs and the output S1 can be an input. Thus, rather than bringing different introduced fluids into contact, it is possible to divide an introduced fluid by dividing the chamber in which it is located.

Referring to FIG. 9, a sixth system according to a sixth embodiment according to the invention is shown.

The sixth system is similar to the second embodiment, but further comprises, in the support means 200, several actuators or sensors 410 arranged so as to be in direct contact with the pumped fluid, and a measuring device 420.

For example, the actuator 410 can include electrodes to create an electrochemical reaction, a heat or ultrasound generator, a light source, a sensor. For example, the measuring devices can make it possible to measure parameters in the chambers.

In this way, it is possible to activate or analyze a single volume of fluid desired and included in a particular chamber.

Referring to FIG. 10, an eighth system according to an eighth embodiment according to the invention is shown.

The eighth embodiment is similar to the fourth embodiment. Here, the membrane 100 does not include through holes. The pump of this eighth mode further comprises the rigid wall 300 fixed on at least one part of the perimeter of the upper surface 102 of the membrane 100 and spaced from the membrane 100 by a distance sufficient to allow the ripple, the ripple involving or avoiding contact between the concave parts and the wall 300 provided that the fluid or fluids circulate through the pump. The support means 200 comprises an inlet E' and an outlet S' and the rigid wall 300 also comprises an inlet E" and an outlet S". In this way, a fluid can circulate between the membrane 100 and the support means 200 and another fluid can circulate between the membrane 100 and the wall 300. Thus, two distinct fluids can be pumped with the same pump and the same flow rate.

Furthermore, it should be noted that with this embodiment, it is also possible for the fluid circulating between the inlet E' and the outlet S' to be the same as that circulating between TE" and the outlet S". In this configuration, the two inlets E' and E" can be interconnected by a channel, for example so as to introduce the same fluid on either side of the membrane 100, and the two outlets S' and S" by another channel so as to extract the same fluid circulating on either side of the membrane 100. Thus, the circulation rate of the fluid in the pump is then doubled.

It should be noted that in each of the embodiments presented above, the rigid support means 200 can be transparent so as to be able to observe the different chambers formed by the ripple. Furthermore, the wall 300 and/or the support means 200 can be transparent so as to allow only the desired and predefined radiation to pass.

It should be noted that throughout this application, when referring to indications in bold type, $F_m$, $C_m$, M, B, $A_n$, reference is made to vectors.

The invention has been illustrated and described in detail in the drawings and the foregoing description. This must be considered as illustrative and given by way of example and not as limiting the invention to this description alone. Many variant embodiments are possible.

In the claims, the word "comprising" does not exclude other elements and the indefinite article "a/an" does not exclude a plurality.

The invention claimed is:

1. A system for pumping a fluid, said system comprising:

a pump comprising:

an inlet and an outlet for respectively introducing and extracting said fluid capable of being pumped, a flexible membrane having two opposite surfaces, said membrane comprising a spatially rotating permanent magnetization structure, a rigid support means on which is fixed at least part of one of said surfaces of said membrane, a source of a magnetic field capable of generating a driving magnetic field at the place where said membrane is located, said driving magnetic field having a substantially homogeneous orientation, said membrane being capable to deform, under the effect of said driving magnetic field, according to a ripple having alternately one or more concave parts and one or more convex parts, the ripple being able to move under the effect of said driving magnetic field, said fluid capable of being pumped between said inlet and said outlet being located at least between one of said surfaces of said membrane and said rigid support means.

2. The system according to claim 1, according to which a projection of said driving magnetic field on a plane of magnetic rotation of the membrane is capable of being temporally rotated.

3. The system according to claim 2, according to which said driving magnetic field is entirely comprised in said plane of magnetic rotation of said membrane.

4. The system according to claim 1, wherein at least one or more of the convex parts are contactable with said rigid support means and at least one or more of the concave parts are not in contact with said rigid support means.

5. The system according to claim 2, wherein said temporally rotating driving magnetic field further exhibits a minimum gradient of 1 T/m and a substantially spatially homogeneous gradient orientation.

6. The system according to claim 2, wherein said rotating driving magnetic field further exhibits a minimum gradient of 1 T/m and a time constant gradient orientation.

7. The system according to claim 5, according to which said membrane is positioned so that said gradient is oriented from a weak surface towards a strong surface, given that:

when the spatially rotating permanent magnetization structure of the membrane rotates counterclockwise from a left end to a right end of the membrane, the strong surface designates an upward exposed surface and the weak surface designates a downward exposed surface, and when the spatially rotating permanent magnetization structure of the membrane rotates, from the left end to the right end of the membrane, in the anti-clockwise direction, the strong surface designates the downward exposed surface and the weak surface designates the upward exposed surface.

8. The system according to claim 1, wherein said membrane has a thickness of between 5 μm and 1 cm.

9. The system according to claim 1, wherein said magnetization structure is defined by a spatial rotation period comprised between 20 μm and 2 cm.

10. The system according to claim 1, further comprising a rigid wall attached to at least a portion of a perimeter of the other of said surfaces of said membrane and spaced from said membrane by a distance d sufficient to allow said ripple and to allow contact between said concave parts and said rigid wall.

11. The system according to claim 1, further comprising a rigid wall attached to at least part of a perimeter of the other of said surfaces of said membrane and spaced from said membrane by a distance d' sufficient to allow said ripple and to avoid contact between said concave parts and said rigid wall.

12. The system according to claim 10, wherein said rigid wall includes an orifice through which a controlled pressure is applied between said rigid wall and said membrane.

13. The system according to claim 10, wherein said membrane has two through orifices, each located at its ends so that said pumpable fluid is also between the other of said surfaces of said membrane and said rigid wall.

14. The system according to claim 10, wherein said rigid wall further comprises a second inlet and a second outlet for respectively introducing and extracting a pumpable fluid between the other of said surfaces of said membrane and said rigid wall.

15. A method of operating the system according to claim 1, comprising the following steps:

a) interaction between said driving magnetic field from said source and said permanent magnetization structure of said membrane so as to create stresses in said membrane causing static deformation of said membrane following the ripple presenting alternately the one or more concave parts and the one or more convex parts, b) rotation of said driving magnetic field so as to displace said stresses in said membrane to move said ripple in an orientation defined according to the direction of rotation of said driving magnetic field, c) displacement of said fluid between said inlet and said outlet, said fluid being comprised at least in one of said concave parts delimited by said membrane and said rigid support means.

16. The method according to claim 15, wherein said source of the driving magnetic field is a permanent magnet.

17. The method according to claim 15, wherein when said driving magnetic field has a substantially spatially homogeneous and constant gradient orientation, said gradient is directed from a weak surface of said membrane to a strong surface of said membrane.

* * * * *